US006220129B1

(12) United States Patent
Shimansky

(10) Patent No.: US 6,220,129 B1
(45) Date of Patent: Apr. 24, 2001

(54) DUAL MULTI-BIT SCREWDRIVER

(75) Inventor: David Shimansky, Cote St Luc (CA)

(73) Assignee: Innovak D.I.Y. Products Inc., Pointe Claire (CA)

( * ) Notice: Subject to any disclaimer, the term of this patent is extended or adjusted under 35 U.S.C. 154(b) by 0 days.

(21) Appl. No.: 09/329,446

(22) Filed: Jun. 11, 1999

(51) Int. Cl.[7] ..... B25G 1/08
(52) U.S. Cl. ..... 81/490; 81/177.4; 81/438
(58) Field of Search ..... 81/490, 177.4, 81/438

(56) References Cited

U.S. PATENT DOCUMENTS

| | | | | |
|---|---|---|---|---|
| 4,227,430 | * | 10/1980 | Jannson et al. | 81/177.4 |
| 4,278,119 | * | 7/1981 | Elmore | 81/177.4 |
| 4,300,607 | * | 11/1981 | Mellinger | 81/490 |
| 5,566,596 | * | 10/1996 | Lin | 81/490 |
| 5,875,692 | * | 4/2000 | Lin | 81/177.4 |
| 5,957,014 | * | 9/1999 | Tseng et al. | 81/438 |
| 6,050,158 | * | 4/2000 | Cassutti et al. | 81/490 |

* cited by examiner

*Primary Examiner*—James G. Smith
*Assistant Examiner*—Lee Wilson
(74) *Attorney, Agent, or Firm*—Swabey Ogilvy Renault; Guy J. Houle

(57) ABSTRACT

A screwdriver wherein the handle has a front and a rear handle section which are mated with one another. A shaft extends axially from the front end of the front handle section. The rear handle section is removably connected to the front handle section. The rear handle section has a shaft extending axially from a front end thereof and located in a central inner bore of the front handle section when the rear handle section is mated with the front handle section. The rear handle section constitutes a stub screwdriver. A screwdriver bit retention magazine is formed in the rear circumferential wall end of the front handle section and has a plurality of cavities having at least a wall portion thereof comprised of a thermoplastic elastomer to provide frictional retention of the bits. The rear handle section and the front handle section are secured in frictional clamping fit by flexible projecting fingers projecting from the rear of the front handle section and which are engaged by clamping teeth projections formed in the rear handle section.

6 Claims, 4 Drawing Sheets

DUAL MULTI-BIT SCREWDRIVER

TECHNICAL FIELD

The present invention relates to a dual screwdriver wherein the handle is made of two sections with the rear section being disconnectable from the front section and constituting a stub screwdriver. In particular the two handle sections are interconnected in clamping function fit and a storage magazine is provided about the periphery of the rear wall of the front handle section by cavities having at least a portion thereof formed of a thermoplastic elastomer section which forms part of the handle to provide improved retention of the bits while providing improved torquing by the hand of a user.

BACKGROUND ART

Multi-bit screwdrivers are known wherein the bits are stored within the handle of the screwdriver and are accessible by disconnecting a portion of the handle. An example of such multi-bit screwdrivers is shown and described in U.S. Pat. No. 4,552,044. With such screwdrivers, it is necessary to change the screwdriver bit every time the screw head has a different shape. Also with such screwdrivers the handle is of a common size and when working in a restricted space that type of screwdriver may not be usable.

Dual screwdrivers having a main screwdriver handle and a disconnectable stub end which is convertable to a stub screwdriver is also known as described in U.S. Pat. No. 5,868,048. This particular patent describes a specific system of interlocking the stub end handle section to the main handle section and the bits are merely retained in a loose arrangement in a hollow section of the handle. Accordingly, these bits are easily lost and only a limited amount of bits can be accommodated.

U.S. Pat. No. 5,881,615 describes a multi-bit screwdriver wherein bits are secured about the outside of the handle in grooves which are sized and shaped to receive a single bit. The bits have opposed screw engaging heads and are retained in the grooves by sliding panels slidingly connected to the handle. The panels only cover a portion of these grooves. Accordingly, when a person grasps the handle, his hand is exposed to irregularities which makes it very uncomfortable. Also, during the torquing application of the handle, stress is imposed upon these sliding panels which can often break. The panels also break when the screwdriver is dropped on a hard surface. Another disadvantage of such screwdriver handles is that the sliding panels may be accidentally displaced thereby accidentally releasing a bit. Also, if one of these sliding panels break, then the groove is no longer useable and the grasping of the handle is rendered even more uncomfortable to the user's hand and without storage space the loose bit becomes lost and the utility of the screwdriver is impaired.

SUMMARY OF INVENTION

It is a feature of the present invention to provide a dual multi-bit screwdriver which substantially overcomes the above-mentioned disadvantages of multi-bit and dual-type screwdrivers of the prior art.

Another feature of the present invention is to provide a dual multi-bit screwdriver wherein the handle is made of two sections and wherein the sections can separate from one another to form two screwdrivers having handles and shafts of different lengths.

Another feature of the present invention is to provide a dual multi-bit screwdriver having a two section handle and wherein the sections are disconnectable from one another by exerting a pulling force and wherein when disconnected provide access to a screwdriver bit magazine protected by the stub handle section.

Another feature of the present invention is to provide a dual screwdriver having a multi-bit capability.

Another feature of the present invention is to provide a dual multi-bit screwdriver wherein the screwdriver bit magazine has at least a section thereof provided with a pliable thermoplastic elastomer to provide frictional retention against the bit and wherein the thermoplastic elastomer also extends in the outer handle surface to provide improved friction retention with the hand of a user person to improve torquing the torque transmitting shaft of the main screwdriver body and the stub screwdriver body.

According to the above features, from a broad aspect, the present invention provides a dual multi-bit screwdriver which comprises a handle having a front and a rear handle section removably interconnected together. An elongated torque transmitting shaft extends axially from a front end of the front handle section. The rear handle section has a short torque transmitting shaft extending axially from a front end thereof and extending within a central inner bore of the front handle section when the rear handle section is mated with the front handle section. Each of the torque transmitting shafts have a chuck cavity at a free end thereof for receiving a screwdriver bit in close friction fit therein. A bit storing magazine is formed in a rear wall of the front handle section and extends about the handle for storing a plurality of spaced-apart screwdriver bits in friction fit retention therein with an end portion of the bits projecting from the magazine sufficiently for removal by finger engagement. The rear handle section has cavity means to receive projection portions of the bits stored in the magazine when the rear handle section is mated with the front handle section.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
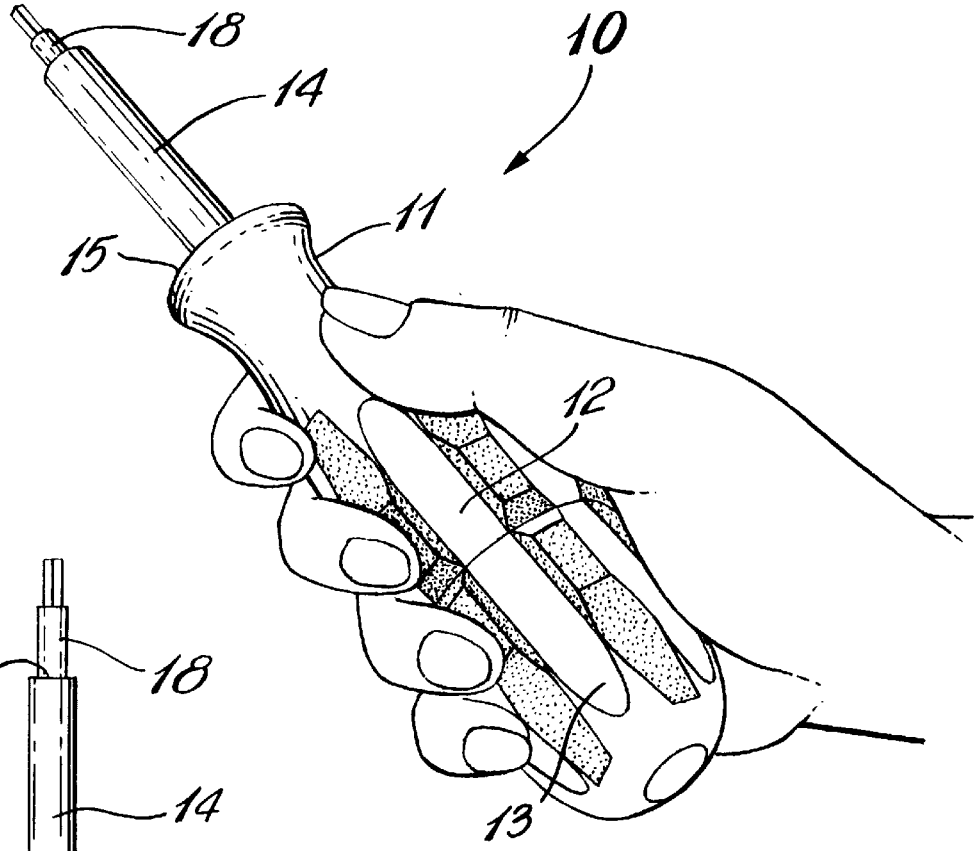
FIG. 1 is a perspective view showing the dual multi-bit screwdriver of the present invention.
Figure 2:
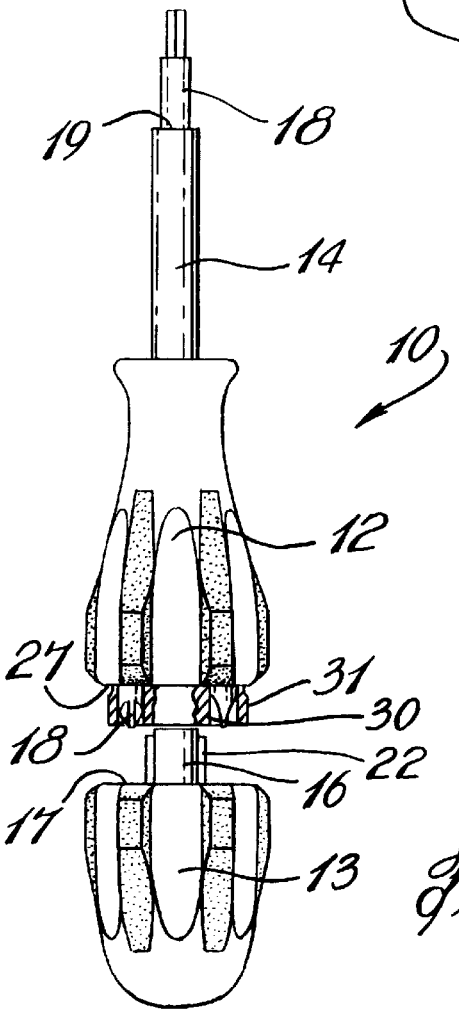
FIG. 2 is a side view of the dual multi-bit screwdriver of the present invention showing the two handle sections separated one another whereby to constitute two screwdrivers.

Referring now to the drawings and more particularly to FIGS. 1 and 2, there is shown generally at 10 the dual multi-bit screwdriver of the present invention. The screwdriver has a handle 11 which is comprised of a front handle section 12 and a rear handle section 13 which are mated in frictional clamping retention with one another. An elongated bit receiving torque transmitting shaft 14 extends axially from the front end 15 of the front handle section 12.

Figure 3:
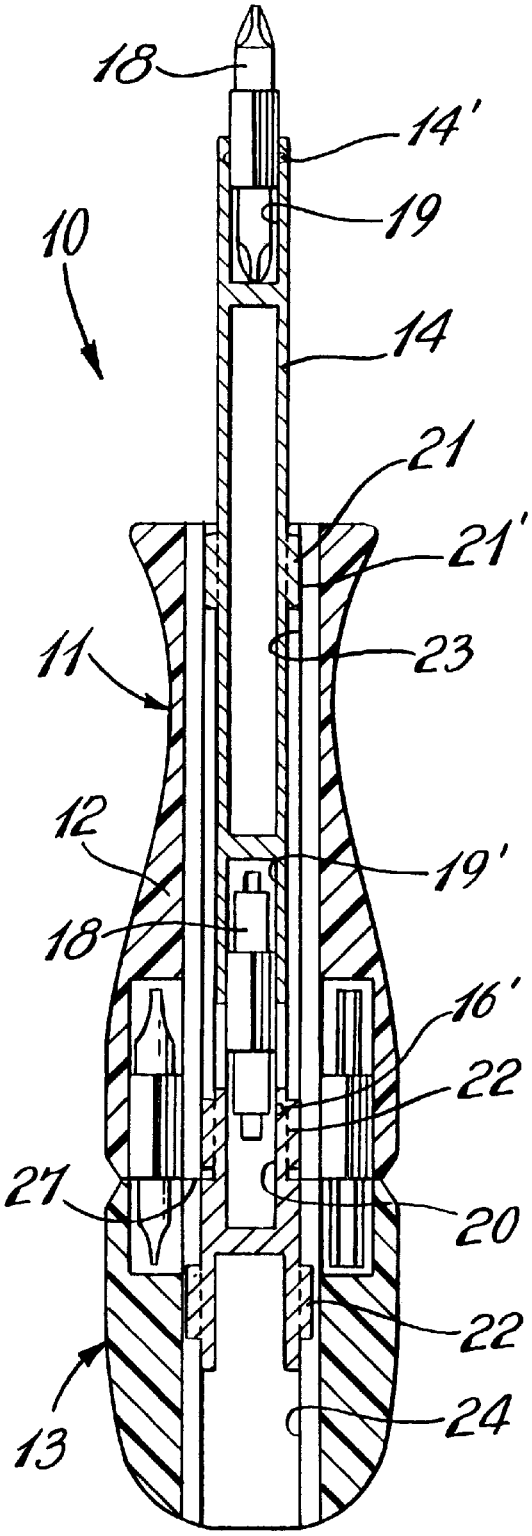
FIG. 3 is a sectional side view of the dual multi-bit screwdriver with the handle sections mated with one another.

As shown in FIG. 2, when the rear handle section 13 is separated from its clamping friction fit with the front handle section 12, the rear handle section 13 constitutes a stub screwdriver and it is also provided with a short bit receiving torque transmitting shaft 16 extending axially from the front end 17 thereof. As hereinshown a screwdriver bit 18 is received within a chuck cavity 19 (see FIG. 3) formed at opposed free ends of the shaft 14. Similarly, as shown in FIG. 3, the front end of the short bit receiving shaft 16 of the rear handle section 13 is provided with a chuck receiving cavity 20 to also receive in close removable fit therein a screwdriver bit 18. The shafts 14 and 16 are provided with an annular groove 14' and 16', respectively, in their bit receiving chuck cavities 19 and 20. A spring bias bearing (not shown) is provided in the bits 18 to engage with the grooves 14' and 16', as well known in the art.

Both the screw bit receiving shafts 14 and 16 are provided with frictional engagement means in the form of shoulder flanges 21 and 22 for frictional retention in locating slots 21' and 22' provided in the outermost sections of the shaft receiving cylinders 23 and 24 secured in the front handle section 12 and rear handle section 13, respectively.

As shown in FIG. 1, a plurality of flexible projecting fingers 30 extend from a rear circumferential body portion 31 of the front handle section 12 and clampingly frictionally engage with clamping teeth projections 32 formed in the rear handle section 13, as will be described later.

Figure 4:
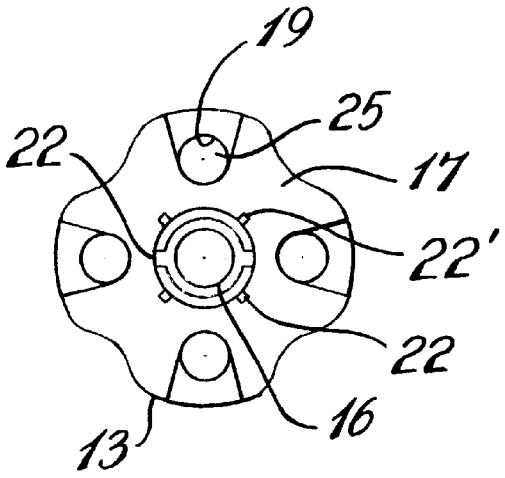
FIG. 4 is an end view showing a modified configuration of the screwdriver bit storage magazine.

With specific reference to FIGS. 3 and 4 it can be seen that when the screwdriver handle sections 12 and 13 are disconnected from one another it exposes a bit storage magazine which is comprised of a plurality of cylindrical cavities 25 which are formed in the end walls 17 and 27 of both the rear handle section 13 and the front handle section 12. The cavities in the front handle section have a cross-section adapted to frictionally retain the bits 18 therein.

Figure 5:
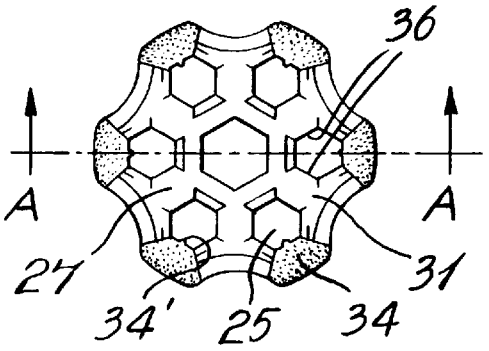
FIG. 5 is a view similar to FIG. 4 showing the configuration of the screwdriver bit storage magazine of the screwdriver embodiment described herein.
Figure 6:
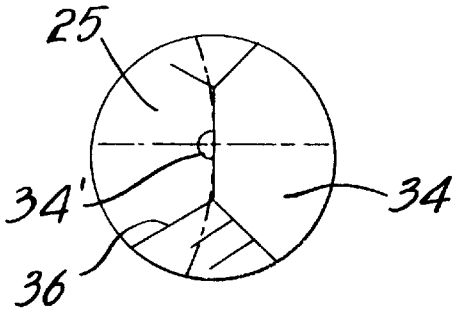
FIG. 6 is an enlarged section view showing the friction projection made in the thermoplastic elastomer portion which projects into the cylindrical cavities of the bit storing magazine.
Figure 7:
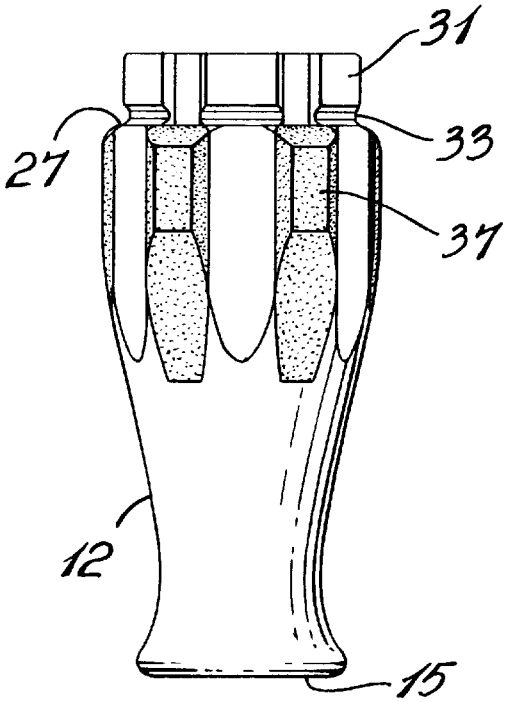
FIG. 7 is a side view showing the construction of the front handle section.

FIG. 5 illustrates that more of these storage cavities 25 can be formed in the end walls of these handle sections wherein to provide multi-bit storage. For example, if eight of these cavities were provided in the end wall and two bits 19 mounted in the chucks 19 and 19' of the bit receiving shaft 14 and with the bits 18 having opposed screw heads, then this would provide eighteen options of screw heads that can be engaged with each of the chuck cavities of both the stub screwdriver formed by the rear handle section 13 and the chuck cavity of the shaft attached to the front handle section 12 thereby giving the screwdriver the possibility of 36 different bit combinations with the use of both screwdrivers formed with the handle sections.

Figure 8:
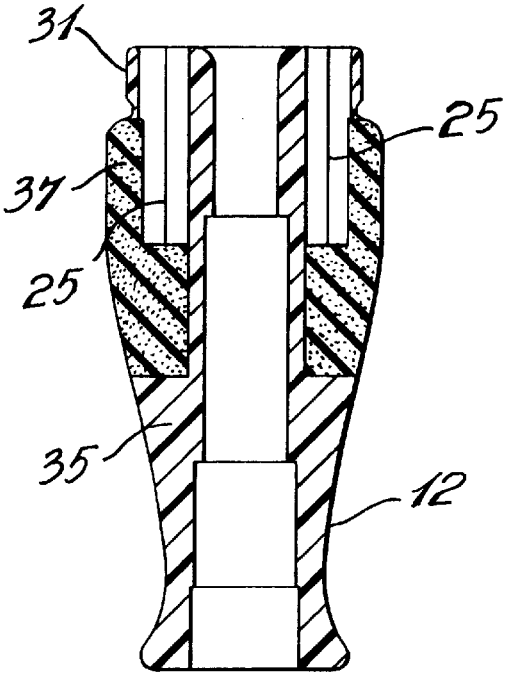
FIG. 8 is a section view of the handle section along cross-section lines A—A of FIG. 5.

Referring now to FIGS. 5 to 8 there will described the construction of the front handle section 12 and its friction clamping fingers. These fingers 31 are recessed from the outer periphery of the front handle section and are provided with a transverse indent 33 at a base thereof above the rear wall 31. The fingers are located intermediate the cylindrical cavities 25 which form the bit storage magazine. As hereinshown, the cylindrical cavities 25 are of hexagonal cross-section and define six wall sections, one of which is constituted by a pliable thermoplastic elastomer 34 which is injection molded to the rigid plastic body portion 35 of the handle, as shown in FIG. 8. The pliable thermoplastic elastomer 34 constitutes an outermost one of the six elongated walls 36 of the cavities 25 and also forms an outer handle section 37 which provides improved frictional retention by the hand of a user person to assist and improve torquing the torque transmitting shaft 14 which projects from the front end 15 of the front handle section 12. The thermoplastic elastomeric wall section 34 is also formed with a projection 34', see FIG. 6, to provide improved frictional retention of a screwdriver bit disposed in the cylindrical cavity 25. As shown in FIG. 3, these bits project sufficiently from the end wall 27 of the front handle section for finer engagement.

Figure 11:
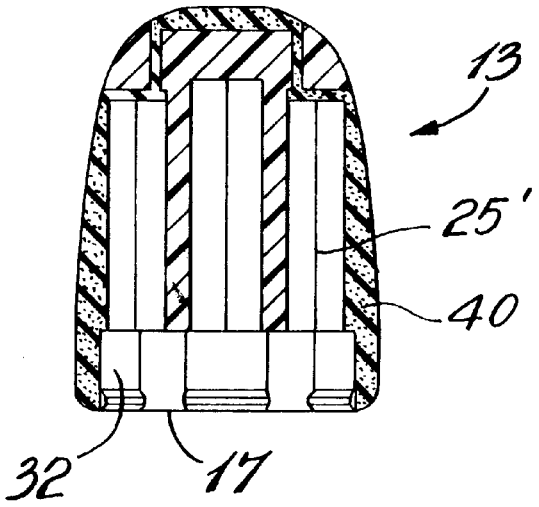
FIG. 11 s a section view along cross-section lines B—B of FIG. 10.
Figure 9:
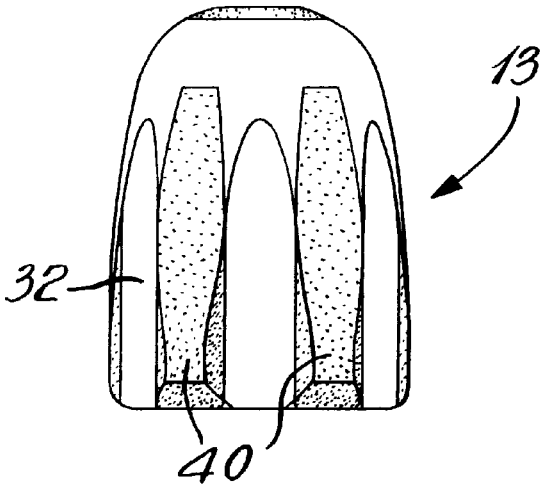
FIG. 9 is a side view of the rear handle section.
Figure 10:
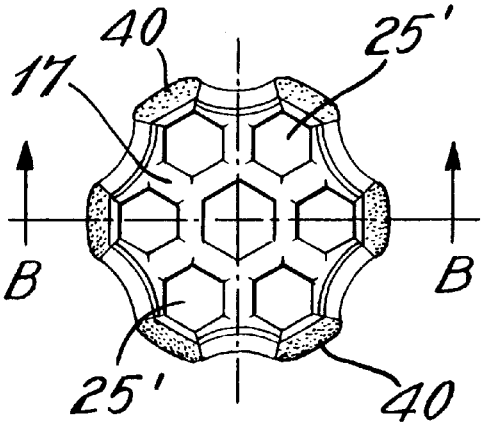
FIG. 10 is an inner end view of the rear handle section shown in FIG. 9.

Referring now to FIGS. 9 to 11, there is shown the construction of the rear handle section 13. As hereinshown it is also provided with pliable thermoplastic elastomeric sections 40 disposed between a plurality of flexible clamping teeth projections 32 spaced apart about the periphery of the rear handle section and dimensioned for flexible clamping engagement with the fingers 31 projecting from the front handle portion 12. When the handle portions are mated together, the elastomeric sections 40 and 37 are in alignment with one another, and as previously described, this enhances gripping and the application of torque to the screwdriver, combined as shown in FIG. 3 or to the stub screwdriver.

As shown in FIG. 10, the stub screwdriver is also provided with cavities 25' dimensioned and aligned with the cavities 25 provided in the front handle section 12. These cavities merely receive the opposed screw head of the bits stored within the cavities 25 and do not provide frictional engagement thereof. Accordingly, the elastomeric sections 40 are not provided with projections 34' as is the case with the elastomeric portions 34 in the front handle section.

In the particular embodiment as shown in FIGS. 5 to 11, which is the preferred embodiment, there are six of the cylindrical cavities 25 and dimensioned to receive screwdriver bits 18 having opposed screw engaging heads. The elongated torque transmitting shaft 14, as shown in FIG. 3, is provided with chuck cavities 19 and 19' at opposed ends thereof and also dimensioned to receive screwdriver bits having opposed screw engaging heads. Accordingly, the screwdriver results in a dual multi-bit screwdriver having a capacity of storing eight screwdriver bits having opposed screw engaging heads to adapt to sixteen different types of screw heads with each the elongated screwdriver combined or the stub screwdriver.

It is within the ambit of the present invention to cover any obvious modifications of the preferred embodiment described herein, provided such modifications fall within the scope of the appended claims.

What is claimed is:

1. A dual multi-bit screwdriver comprising a handle having a front handle section and a rear handle section removably interconnected together, an elongated torque transmitting shaft extends axially from a front end of said front handle section and is provided with frictional retention means, said rear handle section having a short torque transmitting shaft also provided with frictional retention means and extending axially from a front end thereof and extending within a central inner bore of said front handle section when said rear handle section is mated with said front handle section, each said torque transmitting shaft having a chuck cavity at a free end thereof for receiving a screwdriver bit in close friction fit therein, and a bit storing magazine formed in a rear wall of said front handle section and extending about said handle for storing a plurality of spaced-apart screwdriver bits in friction fit retention therein with an end portion of said bits projecting from said magazine sufficiently for removal by finger engagement, said rear handle section having cavity means to receive projection portions of said bits stored in said magazine when said rear handle section is mated with said front handle section, said front and rear handle sections are removably interconnected together by interengaging frictional clamping means, said front handle section having a plurality of flexible projecting fingers extending from a rear circumferential body portion thereof and recessed from an outer periphery thereof, said flexible projecting fingers having a transverse indent therein, said rear handle section having a plurality of flexible clamping teeth projections disposable over said fingers and frictionally engageable in respective ones of said indent, said bit storing magazine is comprised by a plurality of cavities formed in said circumferential portion of said front handle section, and at least an elongated portion of each said cavities being exposed to a portion of a more pliable thermoplastic elastomer than said rear body portion, said at least one elongated portion being an outermost wall of said cavities and forms an outer surface portion of said front handle section, said thermoplastic elastomer providing an outer friction surface to assist in torquing said torque transmitting shaft.

2. A dual multi-bit screwdriver as claimed in claim 1 wherein said cavities are elongated cavities of hexagonal cross-section and define six elongated walls.

3. A dual multi-bit screwdriver as claimed in claim 2 wherein said outermost wall has a projection for frictionally engaging a screwdriver bit in said cavities.

4. A dual multi-bit screwdriver as claimed in claim 2 wherein a plurality of elongated cavities of hexagonal cross-section are provided in a circumferential inner face of said rear handle section and dimensioned to receive the projection portion of bits retained in said cavities of said front handle section, said outer surface portions between said clamping teeth forming an elongated wall portion of said cavities of said rear handle portions.

5. A dual multi-bit screwdriver as claimed in claim 1 wherein said rear handle section constitutes a handle for a stub screwdriver, said handle having outer surface portions between said clamping teeth projections formed of said pliable thermoplastic elastomer to provide an outer friction surface to assist in torquing said toque transmitting shaft thereof.

6. A dual multi-bit screwdriver as claimed in claim 4 wherein there are six of said cavities of said front and rear handle sections and dimensioned to receive screwdriver bits having opposed screw engaging heads.

* * * * *